United States Patent [19]

Hüberli

[11] 3,940,035

[45] Feb. 24, 1976

[54] FOLDED CARTON HAVING DISPENSING MEANS

[75] Inventor: Wilhelm Hüberli, Koniz, Switzerland

[73] Assignee: Zeiler A.G. Werk Koniz, Koniz, Switzerland

[22] Filed: Oct. 29, 1974

[21] Appl. No.: 518,946

[30] Foreign Application Priority Data

Feb. 13, 1974 Switzerland ..... 1978/74

[52] U.S. Cl. ..... 222/528; 229/7 SC; 229/17 SC; 222/556

[51] Int. Cl.[2] ..... B65D 3/00; B65D 5/06

[58] Field of Search ..... 229/7 SC, 7 D, 7 R, 175 C, 229/17 R; 222/527, 528, 529, 530, 531, 182, 556

[56] References Cited

UNITED STATES PATENTS

| | | | |
|---|---|---|---|
| 808,170 | 12/1905 | Rogers | 229/17 SC |
| 1,951,274 | 3/1934 | Denman | 229/7 SC |
| 2,431,786 | 12/1947 | Williamson | 229/17 SC |
| 3,361,308 | 1/1968 | Rumberger | 222/528 |
| 3,791,562 | 2/1974 | Bamburg et al. | 229/7 SC X |
| 3,819,093 | 6/1974 | Forbes, Jr. | 229/17 SC |

*Primary Examiner*—Davis T. Moorhead
*Attorney, Agent, or Firm*—Imirie, Smiley & Linn

[57] ABSTRACT

A folded carton having dispensing means, wherein said dispensing means comprises a displaceable slide which has two terminal positions, in the first of which it exposes a dispensing aperture and in the second, covers the dispensing aperture, the slide being connected to a link portion, the slide and link portion being displaceable between portions of the carton which are capable of elastic displacement in a direction transverse to the plane of the slide, the link portion being thereby displaceable through a dead-center position and firmly held in its terminal positions between said portions of the carton capable of elastic displacement.

7 Claims, 5 Drawing Figures

FOLDED CARTON HAVING DISPENSING MEANS

BACKGROUND OF THE INVENTION

The present invention relates to folded cartons having dispensing means and to a blank from which such cartons can be made. Known folded cartons which have dispensing means are usually provided with a pouring beak or lip which can be produced by suitably deforming one of the walls of the carton, or they have a slide which either exposes or covers a dispensing aperture. Fully automatic production of such folded cartons involves considerable difficulties, particularly if the displaceable or deformable portions have to be made separately and thereafter must be connected to the main body of the box. Storage and despatch of the partially constructed cartons, such as those in which the body portions are glued together but the end flaps are not sealed so that the carton can be flattened, is made much more difficult if pouring channels produced by deforming the folded carton are present. The terminal positions of the displaceable parts which expose and cover the dispensing aperture are not sufficiently well defined in known folded cartons to ensure correct functioning. This is particularly true of the closing of a carton in which the dispensing aperture is regularly used, for example, when the carton contains tablets. Finally, it is extremely difficult to provide displaceable parts to form the dispensing aperture so that not only the aperture may be satisfactorily closed but also that it can be immediately ascertained whether the carton has already been broached.

It is the object of the present invention to provide a folded carton having a dispensing aperture so that the carton can be easily made by fully automatic processes. Moreover, it is a further object of the invention to provide a blank for a carton such that the carton can be easily stored and can be easily opened and securely closed when desired.

According to the present invention there is provided a folded carton having dispensing means, wherein said dispensing means comprises a displaceable slide which has two terminal positions, in the first of which it exposes a dispensing aperture and in the second, covers the dispensing aperture, the slide being connected by a fold to a link portion, the link portion being connected by a fold to a wall portion of the carbon which is non-displaceable in a direction parallel to the plane of the slide, the slide being displaceable between portions of the carton which are capable of elastic displacement in a direction transverse to the plane of the slide.

By so doing, the slide is connected by means of the link to the body of the box. This makes manufacture of the carton relatively simple since it is therefore possible to make the carton from a single, integral blank. When the carton is in its closed position, the parts forming the dispensing device lie flat one upon the other, so that normal stacking of the blank or of the flattened, partially constructed, carton is possible. When the dispensing aperture is in use, the link, and consequently the slide, are each retained by elastic forces in a definite terminal position, hence the dispensing device remains in a usable position for as long as desired. The slide and the dispensing aperture may be covered by a tear-off flap on the unused box. Whilst this flap is present, it means that the carton has not been opened.

The invention will be further described, by way of example, with reference to the accompanying drawings, in which :

DESCRIPTION OF THE PREFERRED EMBODIMENTS

Figure 1:
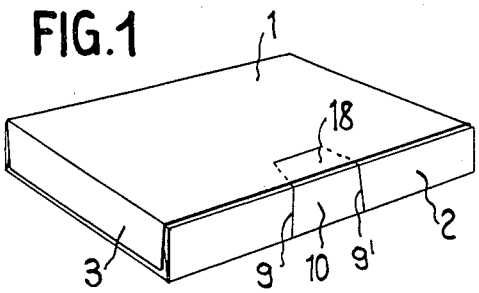
FIG. 1 is a perspective view of a completed carton according to the present invention.
Figure 2:
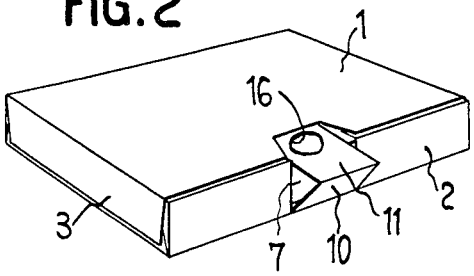
FIG. 2 is a perspective view of the carton of FIG. 1 in its position of use with a dispensing aperture visible.
Figure 3:
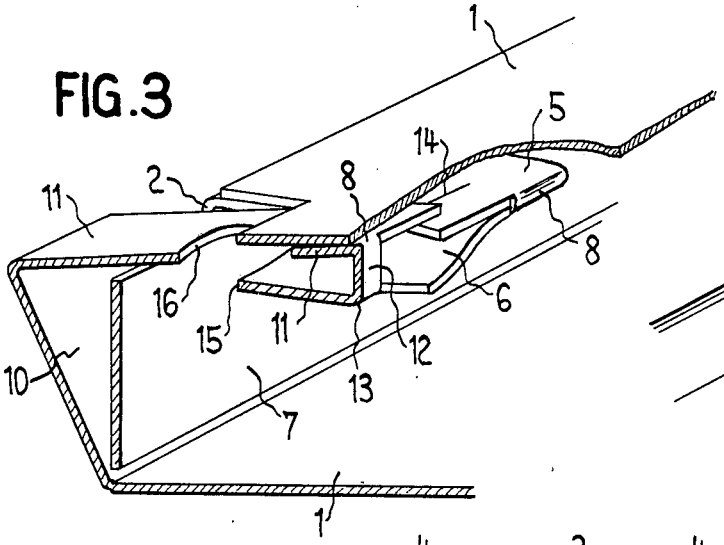
FIG. 3 is a sectioned perspective view through a portion of the carton.
Figure 4:
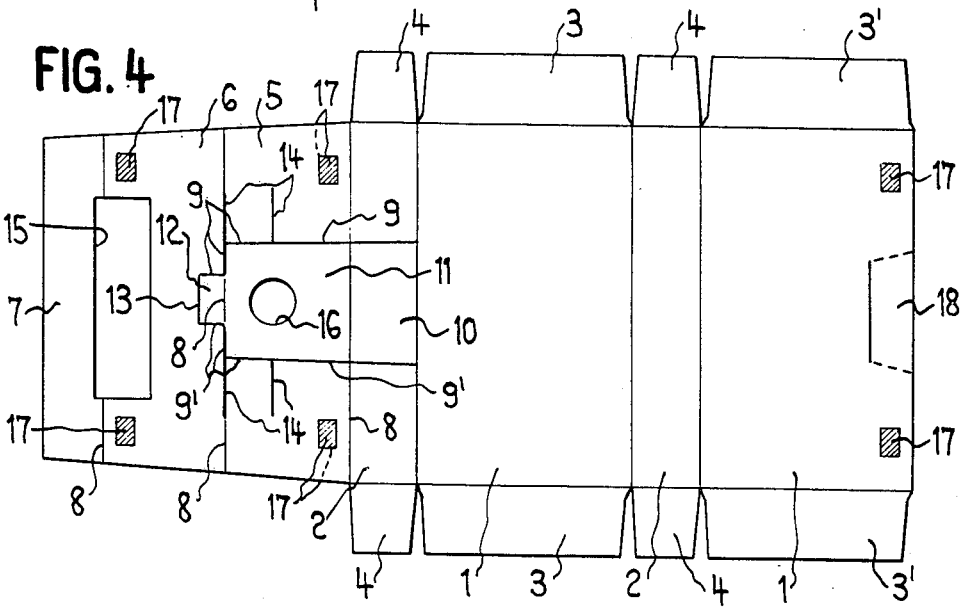
FIG. 4 is a plan view of a blank used for making the carton and, FIG. 5 is a partial perspective view of a second embodiment of the folded carton.

The carton shown in FIGS. 1 to 3 is made from the blank shown in FIG. 4, which comprises, as is customary in carton blanks, top and bottom wall portions 1 and front and rear wall portions 2, as well as end wall portions 3, 3' and 4. The portions are delimited from one another by means of score and, in appropriate places, cut lines. To make the carton, the portions, 3, 3' and 4 are folded and glued to one another. The portions 1, 2, 3, 3' and 4 are common to nearly all cartons. Again, as is common in carton blanks two flap portions 5 and 6 of approximately equal width and a web portion 7 are connected to one of the wall portions 2. Fold lines 8 delimit the interconnected portions 2, 5, 6 and 7 from one another. Symmetrical slits 9, 9' are made in the wall 2 connected to the flap portion 5, and in the portion 5 itself, to produce a tongue is delimited into a wall portion 10, a slide 11 and a link 12 by the fold lines 8. The link 12 forms part of the flap 6 and is delimited therefrom by a fold line 13. The flap 5 is somewhat weakened by longitudinal slits 14 formed therein. A rectangular aperture 15 is formed jointly in the flap 6 and the web 7 whilst a substantially circular dispensing aperture 16 is formed in the slide 11. The shape of the dispensing aperture 16 may be selected in dependence on the product. It may therefore be angular or oval, and the shape of the slide 11 may be selected in dependence upon the shape of the dispensing opening 16. Glueing points 17 are provided adjacent the lateral edges of the flap portions 5 and 6.

In manufacturing the folded cartons, the flap portion 6 is first bent back onto the flap portion 5 by folding along the fold line 8 located between these two portions. The two flap portions are then glued together at the points 17. The web 7 is first disposed flat over the rear wall portion 2 and the wall member 10. The blank is then folded in a conventional manner to form a carton of substantially rectangular cross-section, and glued at the points 17 on the wall portion 1. In this intermediate stage with its end wall portions 3, 3' and 4 unfolded, the carbon tube is usually produced and then laid flat for stacking and transport to the user. The flap portion 5 is thus located directly beneath the wall member 1, the slide 11 being uppermost, whilst the flap portion 6 is located in the interior of the carton and the web 7 is immediately interior of the wall members 2 and 10 (as is shown in FIG. 3) A tearoff flap 18, defined by perforations, becomes located immediately over the slide 11. In this condition, the partially constructed and glued carton may be flattened and stacked or despatched. To complete the manufacture of the carton, one set of the flaps 3, 3' and 4 are combined and glued to form one end wall. The cartons are then filled with their contents and the other end wall is produced by combining and glueing the other end wall. There is thus produced a closed carton as shown in FIG. 1, in which a tear-off flap 18 covers the slide 11, which is therefore invisible in this Figure.

In order to extract the contents of the box, the tear-off flap 18 is removed, thus exposing the outer edge of the slide 11. The outer edge of the slide can now be moved outwardly by digital manipulation. At the same time, the link 12, which initially is in the plane of the flap 6 and lays flat immediately beneath the slide 11, is now tilted upwardly about the fold line 13 which acts as a hinge. Moreover, the flap 5 and 6 move relative to one another until the link 12 reaches the vertical position shown in FIG. 3. Further movement causes the link to swing further in an anti-clockwise (as shown) direction and finally to lie flat on the flap 6 which extends outwardly in an opposite terminal position. The slide 11 is therefore maintained in its outer terminal position as shown in FIG. 2 in which the dispensing aperture 16 has been displaced beneath the wall member 1 until it co-operates with the aperture 15 in the flap 6. The contents of the box can then be dispensed through the apertures 15 and 16. At the same time, the web 7 prevents the contents flowing out laterally of the wall portion adjacent the outwardly displaced wall member 10.

After the extraction of the desired quantity of the contents the slide 11 is returned to its original position by applying pressure against its outer edge. The link 12 is thus returned into its original flat position extending inwardly over the centre position shown in FIG. 3 due to the displacement of the flaps 5 and 6. In both of its terminal positions, the slide 11 is reliably retained in position by the link 12 connected thereto, so that any unintentional opening of the carton is substantially impossible, whilst, in the open position, no unintentional closing of the aperture can take place. The return forces which, due to the displacement of parts of the flaps 5 and 6, act on the link 12 and thus ensure that the open and closed positions are reliably maintained, can be suitably pre-selected in dependence upon material employed and the size of the carton. This is done by suitably dimensioning the length and width of the link 12, and cuts 14 and the size of the aperture 15.

As may be seen most clearly in FIG. 2, the tear-off flap 18 would still completely cover the aperture 16 in the slide 11 even if the slide was extended. It is therefore impossible to remove any of the contents from the carton without at least partly removing the tear-off flap 18. It is therefore possible to ascertain at any time whether the box has been broached or not.

As shown in FIG. 4. the slits 9 and 9' do not extend exactly parallel to one another so that the portion 10 and 11 are somewhat inwardly tapered in the finished carton. This facilitates movement of the slide 11 because its lateral cut edges are caused to rise immediately from the cut surfaces of the flap 5 when the slide is drawn out, and cannot therefore remain attached thereto.

Figure 5:
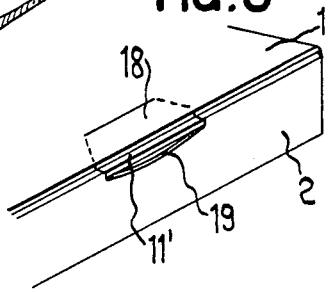

In the embodiment shown in FIG. 5, the slide 11' is not connected to the wall portion 10 of the continuous wall 2. The narrow side 2 has a flat cut-out portion 19 located under the front edge of the slide 11'. After the removal of the tear-off flat 18, the outer edge of the slide 11' can be gripped, and the slide drawn out. In all other respects, the design and operation of the folded carton are as described with reference to FIGS. 1 to 4.

What I claim is:

1. A folded carton having dispensing means, wherein said dispensing means comprises a displaceable slide which has two terminal positions, the first exposing a dispensing aperture and the second closing the dispensing aperture, the slide being connected by a first fold to a link portion, the link portion being connected by a second fold to a wall portion of the carton which is non-displaceable in a direction parallel to the plane of the slide, the link being disposed for rotating displacement about said first and second folds and being sandwiched between portions of the carton which are capable of elastic displacement in a direction transverse to the plane of the slide, said portions of the carton being elastically spread upon rotating displacement of said link occurring during shifting of said slide from one of its terminal positions into the other, the link passing thereby through unstable intermediate positions, and said slide being firmly held in each of its terminal positions by the resilient force of said portions capable of elastic displacement.

2. A carton as claimed in claim 1 wherein an edge of the slide opposite said first fold coincides with an edge of the carton when said slide is in one of said terminal positions.

3. A carton as claimed in claim 2 in which the slide is connected along said outer edge to another displaceable wall portion of the carton, which wall portion is located at right angles to the plane of the slide.

4. A carton having a glued body and ends formed by glued flaps and dispensing means, wherein said dispensing means comprises a displaceable slide which has two terminal positions, the first exposing a dispensing aperture and the second covering the dispensing aperture, said slide lying parallel with one side wall of the casing, two flaps folded one upon the other and glued together at selected points, said points at which the two flaps are glued also forming glueing points for the body of the carton, the slide being cut out of the outermost flap and being connected along one edge to an adjoining wall portion forming part of the body, the slide being also connected along an opposite edge by a first fold to a link portion, the link portion being connected by a second fold to the innermost flap, said slide being disposed between said innermost flap and said one side wall of said casing, movement of said slide causing elastic displacement of said innermost flap away from said one side wall in a direction transverse to the plane of the slide by the rotational displacement of said link whereby said slide may be maintained in each of its terminal positions.

5. A carton as claimed in claim 4 wherein the slide and innermost flap are each provided with an aperture which apertures at least partially over-lap when the slide is in its opened position.

6. A carton as claimed in claim 4 wherein at least one of the flaps is provided with slits to assist deformation thereof in a direction transverse to the plane of the flap.

7. A carton as claimed in claim 4 wherein a web is connected to the innermost flap and is disposed adjacent the interior of the adjoining wall member.

* * * * *